United States Patent [19]

Goloff

[11] 4,106,466

[45] Aug. 15, 1978

[54] ENGINE VALVE WITH RECESSED SEAT AND ANNULAR GROOVE

[75] Inventor: Alexander Goloff, East Peoria, Ill.

[73] Assignee: Caterpillar Tractor Co., Peoria, Ill.

[21] Appl. No.: 714,449

[22] Filed: Aug. 16, 1976

[51] Int. Cl.[2] ..... F01L 3/00

[52] U.S. Cl. ..... 123/188 S; 123/188 R

[58] Field of Search ..... 123/188 R, 188 M, 188 S; 123/41.77; 281/359, 360, 363

[56] References Cited

U.S. PATENT DOCUMENTS

| | | | |
|---|---|---|---|
| 1,415,374 | 5/1922 | Lovejoy | 123/188 S |
| 1,716,890 | 6/1929 | Hofmann | 123/188 S |
| 1,949,613 | 3/1934 | McDonald | 123/188 S |
| 2,665,675 | 1/1954 | Sheppard | 123/188 S |
| 3,046,965 | 7/1962 | Kauffmann et al. | 123/188 S |

FOREIGN PATENT DOCUMENTS

| | | | |
|---|---|---|---|
| 2,238,750 | 2/1974 | Fed. Rep. of Germany | 123/188 S |
| 477,267 | 1/1953 | Italy | 123/188 S |
| 366,423 | 2/1963 | Switzerland | 123/188 S |

*Primary Examiner*—Charles J. Myhre
*Assistant Examiner*—David D. Reynolds
*Attorney, Agent, or Firm*—Phillips, Moore, Weissenberger, Lempio & Strabala

[57] ABSTRACT

An engine cylinder head has valves reciprocally mounted thereto, each valve having a head which is seatable against a seat. The seat is recessed in a cylindrical bore defined by the head, the outer periphery of the head being in close proximity to the surface of the bore, with the head on the seat. The valve apparatus maintains a substantially closed valving state as the head is moved from the seat, until the head is removed from the bore.

7 Claims, 7 Drawing Figures

ENGINE VALVE WITH RECESSED SEAT AND ANNULAR GROOVE

BACKGROUND OF THE INVENTION

This invention relates to valving apparatus, and more particularly, to apparatus wherein the heads of poppet-type valves are movable to positions recessed relative to the cylinder head.

In a generally known type of valve configuration, including poppet valves, the poppet valves include beveled portions which are positionable against seat portions defined by a cylinder head to determine a closed valving state thereof. See, for example, U.S. Pat. Nos. 1,589,441, 2,191,333, 3,209,737, 3,285,235 and 3,563,214. In general, it will be seen in each of these patents that initial movement of a valve to move the head from the seat determines the beginning of the actual effective opening of the valve. In systems of the type disclosed in these patents, it is well known that the initial lifting and final seating of a valve must take place in a relatively gradual manner, i.e., there must not be what would be abrupt openings and closings, since the forces involved for such abrupt openings and closings would be extremely great. Yet, it is also well known that an ideal operation of a poppet valve of the type disclosed would come about if such a valve could be made to snap instantaneously to a full-open position, to stay open for the needed duration, and then to snap closed instantaneously. This is clearly impossible to achieve in practice because infinitely high loads would be necessary to achieve instantaneous lifts. However, it will be understood that it is desirable to approach such an ideal condition, even if the achievement of such ideal condition is not possible.

SUMMARY OF THE INVENTION

It is accordingly an object of this invention to provide valve apparatus which provides an improvement in lift characteristics thereof.

It is a further object of this invention to provide valve apparatus which, while fulfilling the above object, is extremely simple in design and effective in use.

It is a still further object of this invention to provide valve apparatus which, while fulfilling the above objects, provides that proper cooling thereof takes place.

Broadly stated, the invention comprises a valve apparatus comprising main body means and a valve member movably mounted to said main body means so as to be reciprocal relative thereto, and comprising a valve stem and a valve head. The main body means defines a seat portion against which the valve head may seat, the valve member being movable relative to the main body means to move the valve head away from the seat portion. The main body means define a bore adjacent to the seat portion, the outer periphery of the valve head being positioned in close proximity to the surface of the bore as the valve head is moved from the seat portion, so that the valve member and main body means maintain an effectively closed valve state as the valve head is removed from the seat portion, until the outer periphery of the valve head is moved from within the bore. The main body means further defines an annular groove located about the bore.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
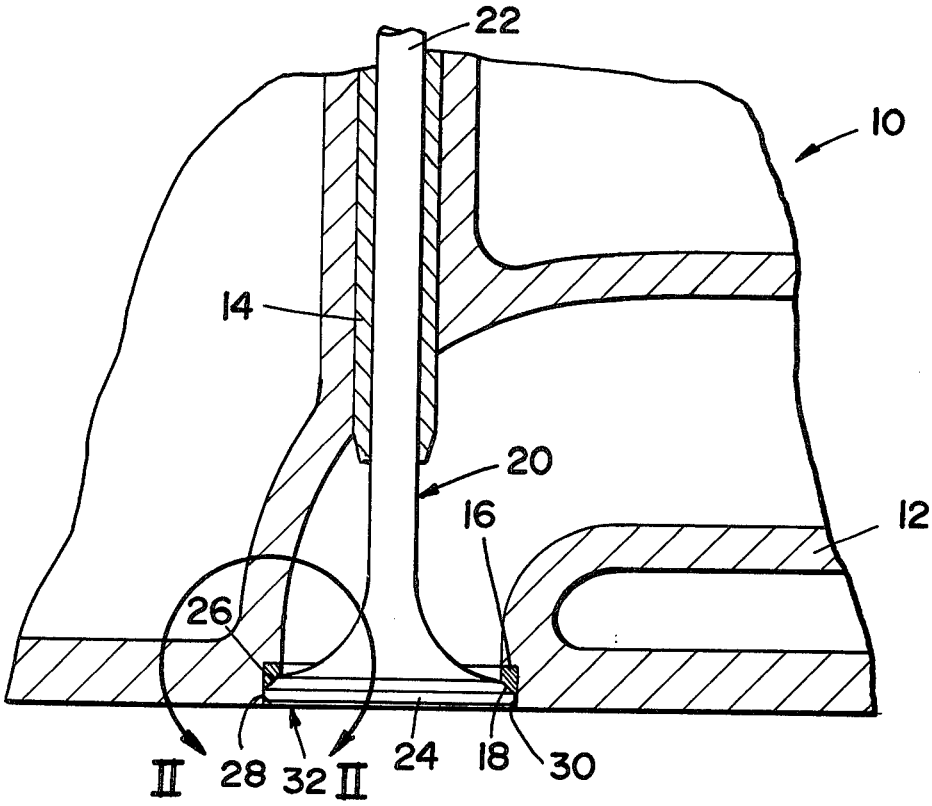
FIG. 1 is a sectional view of a first embodiment of the apparatus.
Figure 2:
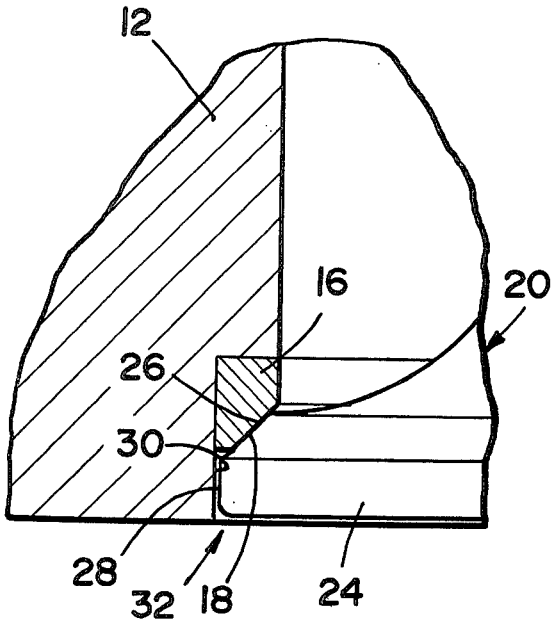
FIG. 2 is an enlarged view of the area II—II of FIG. 1.
Figure 3:
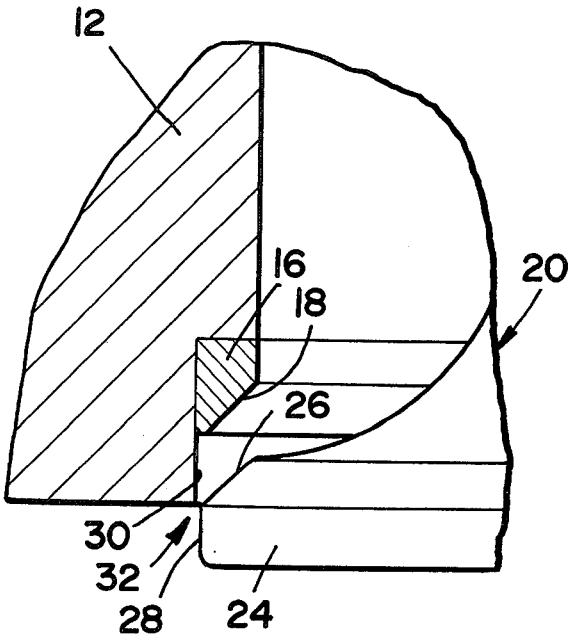
FIG. 3 is a view similar to that shown in FIG. 2, but with the valve head moved from the seat.

Shown in FIGS. 1–3 is a first embodiment of the invention. As shown therein, the apparatus includes main body means 10 made up of a main body 12 in the form of cylinder head, a valve guide 14 mounted thereto and an insert 16 secured relative to the main body 12 and defining an annular seat portion 18. A valve member 20 is movably mounted to the main body 12, having its stem 22 reciprocably mounted in guide 14, and its head 24 secured relative to the stem 22, as is well known. The head 24 defines a beveled portion 26, which may seat against the seat portion 18, the valve member 20 being movable relative to the main body means 10 to move the head 24 away from and toward the seat portion 18.

The valve head 24 has a circular outer periphery 28 actually defining a cylindrical portion. With the valve head 24 on the seat portion 18, the outer periphery 28 of the head is positioned in close proximity to the surface 30 of a cylindrical bore 32 defined by the body 12, and within which the insert 16 is fitted. It is to be understood that with valve head 24 in contact with the seat 18 as shown in FIGS. 1 and 2, a closed valve state is determined. From such state, as the valve head 24 is moved away from the seat portion 18, the outer peripheral surface 28 of the cylindrical portion of the head 24 remains in close proximity to the surface 30 of the cylindrical bore 32 so that the valve member 20 and main body means 10 maintain an effectively closed valve state as the valve head 24 is removed from the seat portion 18, until the outer periphery 28 of the valve head 24 is moved from within the cylindrical bore 32. The initial portion of this state is shown in FIG. 3.

Further movement of the valve member 20 from the FIG. 3 position results in the outer periphery 28 of the valve head 24 being drawn away from the surface 30 of the cylindrical bore 32 and from the main body means 10 to determine an effective open valve state in the conventional sense.

Figure 7:
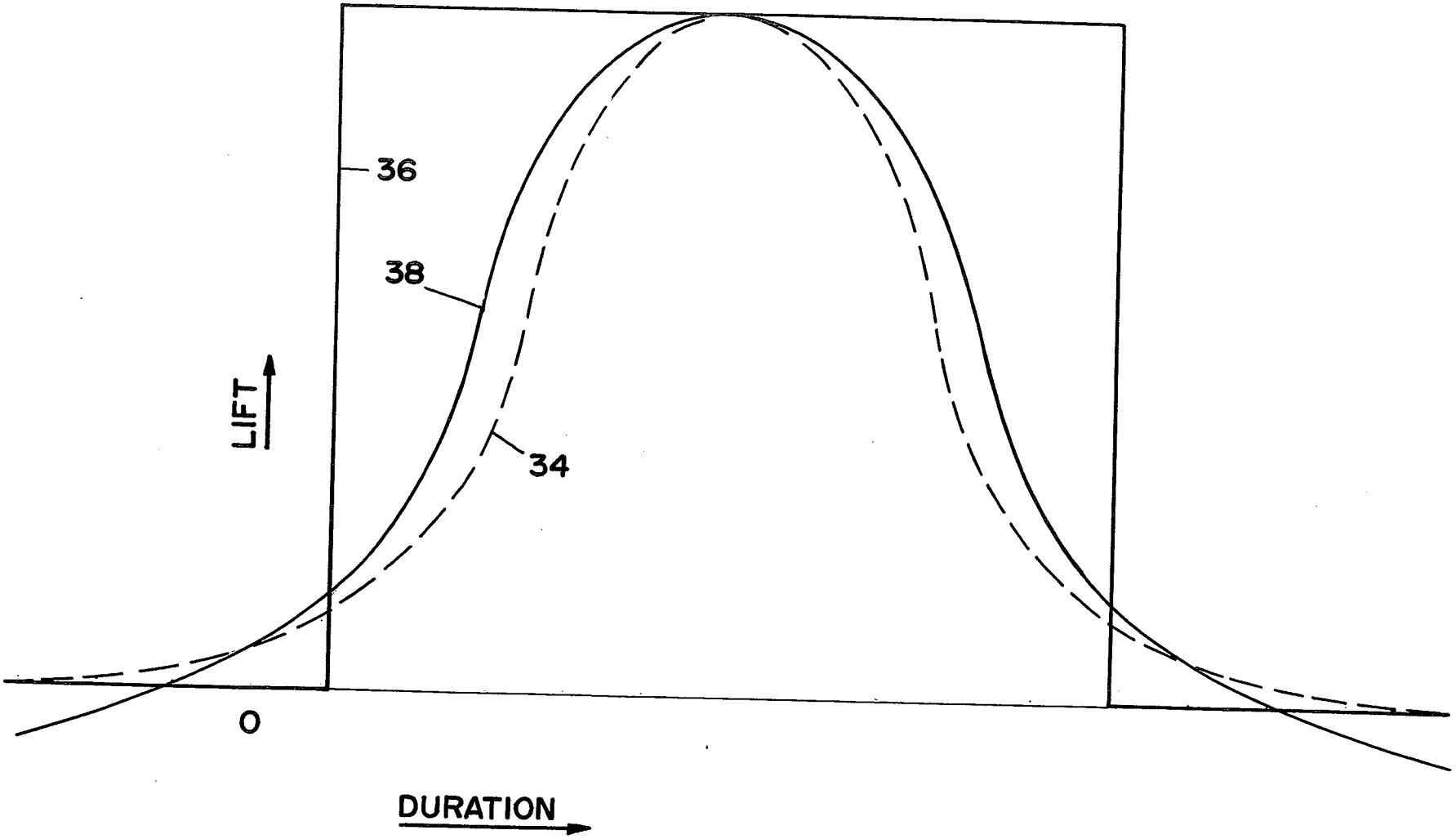
FIG. 7 is a graphical illustration of the effective lift of the present valve in comparison with the lift of a conventional poppet-type valve and in comparison with an ideal curve for a poppet-type valve.

It will be understood that the apparatus thus far described operates in a similar manner upon the valve head 24 being moved toward the seat portion 18, effective closing actually taking place before the valve head 24 seats on the seat portion 18. Reference is made to FIG. 7 wherein a lift curve of a conventional poppet-type valve is shown at 34. It is to be seen that the initial opening and final closing takes place in a very gradual manner in accordance with the above discussion. This curve is quite far removed from the ideal curve shown at 36. The curve at 38 shows the effective lift of the valve member 20 of the present invention, it being remembered that the effective valve lift of the member 20 actually takes place before the valve-open state is achieved and after the valve-closed state is achieved. It will be seen that, while initial and final movements of the valve member 20 of the present invention are quite similar to that of the conventional system, the valve member 20 of the present invention is moving at a substantial velocity at the instant that valve opening occurs, so that higher overall effective valve lift can be achieved. This is clearly shown in FIG. 7. It is to be noted also that the effective lift curve of the valve member 20 of the present invention is somewhat closer to the ideal curve shown at 36 which is discussed above.

It will also be noted that it is possible to provide shorter, effective cam duration, when so desired, the effective duration being shortened since the valve apparatus is effectively closed with the valve head 24 within the cylindrical bore 32.

Not only can higher valve lift be achieved, but the valve system can achieve the optimum effective Lift-/Diameter ratio of approximately 0.26 to 0.28, earlier in the cycle of movement of the valve member 20.

It will be seen that the valve member 20 actually acts as a slide valve member at low valve lifts and at higher lifts becomes a conventional poppet-type valve. Such a system, as thus disclosed, has been found to improve the volumetric efficiency and lessen the pumping losses of the apparatus so as to improve the engine-breathing characteristics consistent with desired engine performance.

Figure 4:
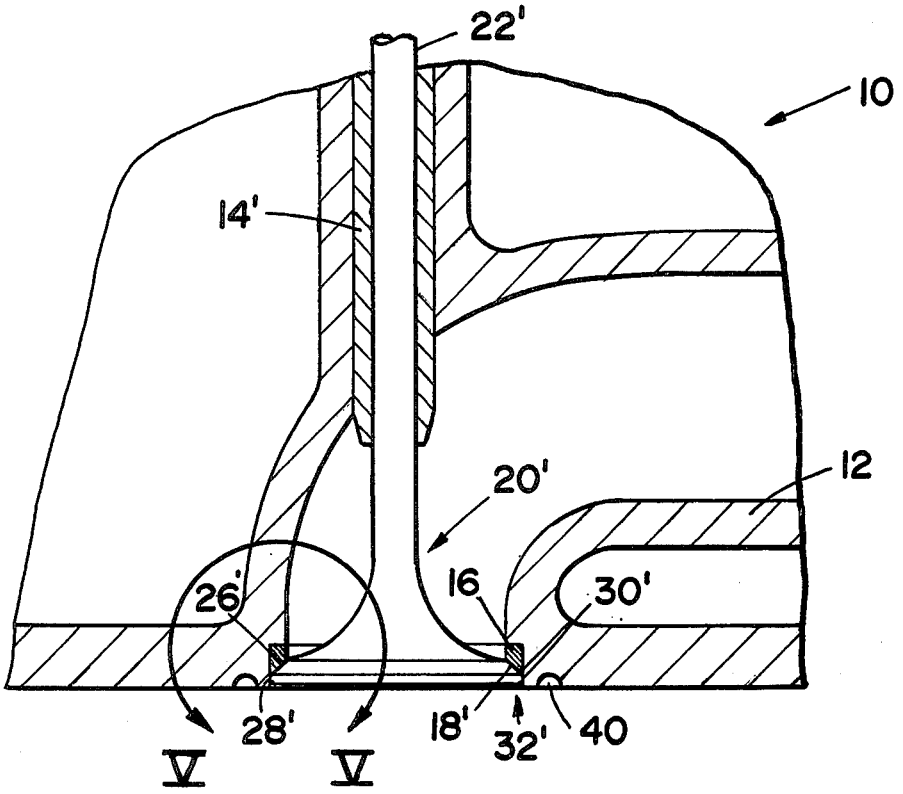
FIG. 4 is a sectional view of a second embodiment of the apparatus.
Figure 5:
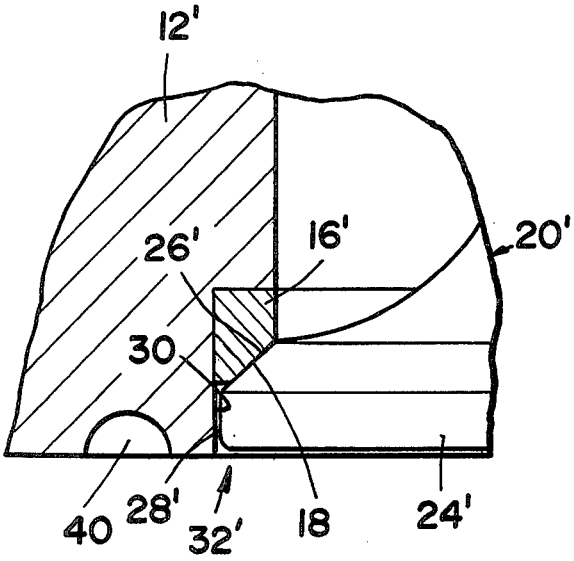
FIG. 5 is an enlarged view of the area V—V of FIG. 4.

In FIGS. 4 and 5, the main body 12' defines an inner annular groove 40 larger in diameter than the cylindrical bore 32', and disposed thereabout, being adjacent to the cylindrical bore 32' and the insert 16'. The groove 40 can be semi-circular in cross-section, the axis thereof being substantially coincident with the cylinder axis of the cylindrical bore 32' and with the axis of the cylindrical portion 28' of the valve head 24'. Such an annular groove 40 is included to minimize the effects of cylinder head distortion which may occur under certain conditions, insuring an effective operation of the system as described above.

Figure 6:
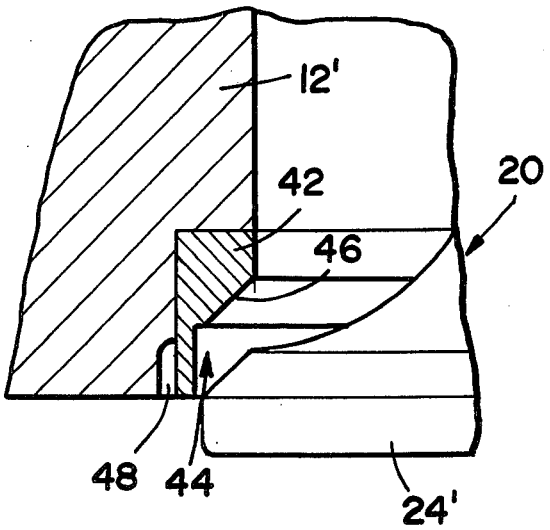
FIG. 6 is a view similar to that shown in FIG. 5, but of a third embodiment of the apparatus and with the valve head removed from the seat.

Reference is made to FIG. 6 for yet another embodiment, wherein an insert 42 is secured relative to the main body 12, the insert itself defining a cylindrical bore 44 within which the cylindrical outer periphery 28 of the valve head 24 may be disposed. The insert 42 defines the seat portion 46 of the apparatus and the insert 42 and main body 12 together define an annular groove 48 similar in positioning and function to the annular groove 40 disclosed in FIGS. 4 and 5, for minimizing the effect of cylinder head distortions as described above, so as to insure proper operation of the invention in accordance with the above description.

I claim:

1. Valve apparatus comprising:

main body means;

a valve member movably mounted to said main body means so as to be reciprocable relative thereto, and comprising a valve stem and a valve head;

the main body means defining a seat portion against which said valve head may seat, the valve member being movable relative to the main body means to move the valve head away from the seat portion;

the main body means defining a bore adjacent the seat portion, the outer periphery of the valve head positioned in close proximity to the surface of the bore as the valve head is moved from the seat portion, so that the valve member and main body means maintain an effectively closed valve state as the valve head is removed from the seat portion, until the outer periphery of the valve head is moved from within the bore, wherein the bore is a cylindrical bore, and wherein the main body means define an annular groove located about the bore, the axis of the groove being substantially coincident with the cylinder axis of the cylindrical bore and wherein the annular groove is substantially semi-circular in cross-section.

2. The apparatus of claim 1 wherein the bore is cylindrical in configuration, and the valve head has a circular outer periphery.

3. The apparatus of claim 2 wherein the valve head defines a cylindrical portion, the outer peripheral surface of which is in close proximity to the surface of the cylindrical bore with the valve head against the seat portion.

4. The apparatus of claim 3 wherein the main body means comprise a main body and an insert secured relative thereto, the insert defining the seat portion.

5. The apparatus of claim 1 wherein the main body means comprise a main body and an insert secured relative thereto, the insert defining the seat portion, an inner cylindrical side of the annular groove being defined by the insert, and an outer cylindrical side and at least a portion of an annular base of the annular groove being defined by the body portion, so that the inner cylindrical side does not contact the outer cylindrical side during valve operation.

6. Valve apparatus comprising:

main body means;

a valve member movably mounted to said main body means so as to be reciprocable relative thereto and comprising a valve stem and a valve head;

a main body portion defining a seat portion against which said valve head may seat, the valve head being movable relative to the main body means to move the valve head away from the seat portion;

the outer periphery of the valve head being circular in configuration; the seat portion being annular in configuration;

the main body means defining an annular groove adjacent to the seat portion, the axis of which is substantially coincident with the axis of the circular outer periphery of the valve head, and wherein the annular groove is substantially U-shaped in cross-section.

7. The apparatus of claim 6 wherein the main body means comprise a main body and an insert secured relative thereto, the insert defining the seat portion, an inner cylindrical side of the annular groove being defined by the insert, and an outer cylindrical side and at least a portion of an annular base of the annular groove being defined by the body portion, so that the inner cylindrical side does not contact the outer cylindrical side during valve operation.

* * * * *